US006600096B2

(12) United States Patent
Jarvis

(10) Patent No.: US 6,600,096 B2
(45) Date of Patent: Jul. 29, 2003

(54) GUARD TO PROTECT TUNING ADJUSTMENTS ON A STRING MUSICAL INSTRUMENT

(76) Inventor: Richard D. Jarvis, 7 Sunrise Ter., East Granby, CT (US) 06026

( * ) Notice: Subject to any disclaimer, the term of this patent is extended or adjusted under 35 U.S.C. 154(b) by 50 days.

(21) Appl. No.: 09/859,602

(22) Filed: May 18, 2001

(65) Prior Publication Data

US 2002/0170412 A1 Nov. 21, 2002

(51) Int. Cl.[7] ..... G10G 7/00
(52) U.S. Cl. ..... 84/453; 84/304; 84/312 R
(58) Field of Search ..... 84/453, 291, 293, 84/304, 312 R, 267

(56) References Cited

U.S. PATENT DOCUMENTS 3,329,054 A * 7/1967 Faillaci ..... 84/267

* cited by examiner

*Primary Examiner*—Shih-Yung Hsieh
(74) *Attorney, Agent, or Firm*—Robert S. Smith

(57) ABSTRACT

A guard assembly for preventing accidental movement of the tuning adjustments for adjusting the tension of strings on an associated string instrument, the guard assembly which includes a bracket, the bracket being generally U-shaped and having spaced legs dimensioned and configured for gripping opposed surfaces of the head of an associated string instrument, the guard assembly further including first and second guard elements mounted on the bracket, each of the guard elements is generally sleeve shaped and dimensioned and configured to extend around a plurality of keys on the associated string instrument. In some forms of the invention the spaced legs are each substantially planar and are disposed in mutually parallel relationship and the legs are joined by a portion of the bracket which is dimensioned and configured to provide apparatus for elastic engagement of the spaced legs with opposed surfaces of the associated head of the associated string musical instrument. The guard assembly may be substantially entirely manufactured from a single piece of plastic. Some other forms of the invention may have at least a part of each of the guard elements supported by a plastic hinge whereby the part is movable away from keys of the associated guitar. Each of the guard elements may be movable between a first position in which each of the guard elements is disposed in closely spaced relationship to associated tuning elements of the associated string musical instrument and a second position wherein the guard elements are positioned in more widely spaced relationship to the associated tuning elements of the associated string musical instrument. Other forms of the invention may include a discrete bracket, the bracket is generally U-shaped and has spaced legs dimensioned and configured for gripping opposed surfaces of the head of the associated string instrument, a guard member having integral first and second guard elements, each of the guard elements is generally sleeve shaped and dimensioned and configured to extend around a plurality of keys on the associated string instrument.

7 Claims, 4 Drawing Sheets

GUARD TO PROTECT TUNING ADJUSTMENTS ON A STRING MUSICAL INSTRUMENT

BACKGROUND OF THE INVENTION

The invention relates to string musical instruments and particularly to a guard for preventing accidental changes in the tuning of string musical instruments. While the invention has particular application to guitars, those skilled in the art will realize that the invention also has application to other string musical instruments including not only those that are in the same family as the guitar as well as various other types of string musical instruments. The description herein will refer specifically to guitars to illustrate the construction of the preferred embodiment. Notwithstanding this reference herein it will be understood that the invention has application to a much broader class of string musical instruments including, but not limited to violins and fiddles. Similarly, it will also be understood that the invention has application to both acoustic and electronic guitars.

The guitar is a member of the fretted instrument family in which the pitch of the strings is altered by pressing them down behind 'frets', which are metal strips attached to the finger-board. Other members of the same family include the banjo, mandoline, bazouki, balalaika and ukulele. Guitars of whatever type—classic, flamenco, plectrum, acoustic, 12-string, Hawaiian or electric—are all descendants of the instrument which evolved over the centuries, mainly in Spain. The traditional guitar has a body that includes a sound table, board or top. The sound table encloses the body which as incurved sides. A single sound hole extends through the sound table into the interior of the body. An elongated neck extends from the body to a head or headstock. The head includes structure for adjusting the tension on the six strings which extend from a saddle and bridge assembly mounted on the sound table to a so-called tuning machine located on the head or headstock. Six strings extend from the saddle and bridge assembly to the tuning machine. The tuning machine includes a key for each string. Each key is cylindrical and has a thumb screw shaped surface for adjusting the tension on an individual string by tuning being key which has one of the strings wrapped around it's cylindrical surface. The elongated neck carries frets, which carry the strings attached to a bridge fixed to the lower part of the soundboard.

The tuning of the guitar is achieved by tuning keys located at the extreme end of the neck that is most remote from the body. Each key is a cylindrical body mounted for rotation about the axis thereof. Each string is wrapped around an individual key. Tightening or loosening the string with an individual key is achieved by the rotation of the key. Once the tension on the string has been set by turning the key, friction between the support for the key and the key prevents subsequent movement and change in the tension and tuning of the respective string. The frictional retention of the key is sufficient for most purposes. However, even the slightest bump of the key will often result in a substantial change in the tuning of the instrument. Once the tuning is changed it is necessary to retail and the instrument. Typically, it will take approximately one-half hour to to the instrument once the settings have been changed.

SUMMARY OF THE INVENTION

It is an object of the present invention to provide apparatus which will protect the tuning mechanism of a string instrument and minimize the requirement for unnecessary tuning procedures.

Another object of the invention is to provide apparatus which is light and easy to install and remove to minimize interference with the normal operation of the string instrument.

Yet another object of the invention is to provide apparatus to protect the string instrument that made the manufactured easily and inexpensively.

It has now been found that these and other objects of the invention may be attained in a guard assembly for preventing accidental movement of the tuning adjustments for adjusting the tension of strings on an associated string instrument, the guard assembly which includes a bracket, the bracket being generally U-shaped and having spaced legs dimensioned and configured for gripping opposed surfaces of the head of an associated string instrument, the guard assembly further including first and second guard elements mounted on the bracket, each of the guard elements being generally sleeve shaped and dimensional and configured to extend around a plurality of keys on the associated string instrument.

In some forms of the invention the spaced legs are each substantially planar and are disposed in mutually parallel relationship and the legs are joined by a portion of the bracket which is dimensioned and configured to provide means for elastic engagement of the spaced legs with opposed surfaces of the associated head of the associated string musical instrument. The guard assembly may be substantially entirely manufactured from a single piece of plastic.

Some other forms of the invention may have at least a part of each of the guard elements supported by a plastic hinge whereby the part is movable away from keys of the associated guitar. Each of the guard elements may be movable between a first position in which each of the guard elements is disposed in closely spaced relationship to associated tuning elements of the associated string musical instrument and a second position wherein the guard elements are positioned in more widely spaced relationship to the associated tuning elements of the associated string musical instrument.

Other forms of the invention may include a discrete bracket, the bracket is generally U-shaped and has spaced legs dimensioned and configured for gripping opposed surfaces of the head of the associated string instrument, a guard member having integral first and second guard elements, each of the guard elements is generally sleeve shaped and dimensioned and configured to extend around a plurality of keys on the associated string instrument.

BRIEF DESCRIPTION OF THE DRAWING

The invention will be better understood by reference to the accompanying drawing in which.

DESCRIPTION OF THE PREFERRED EMBODIMENTS

Figure 1:
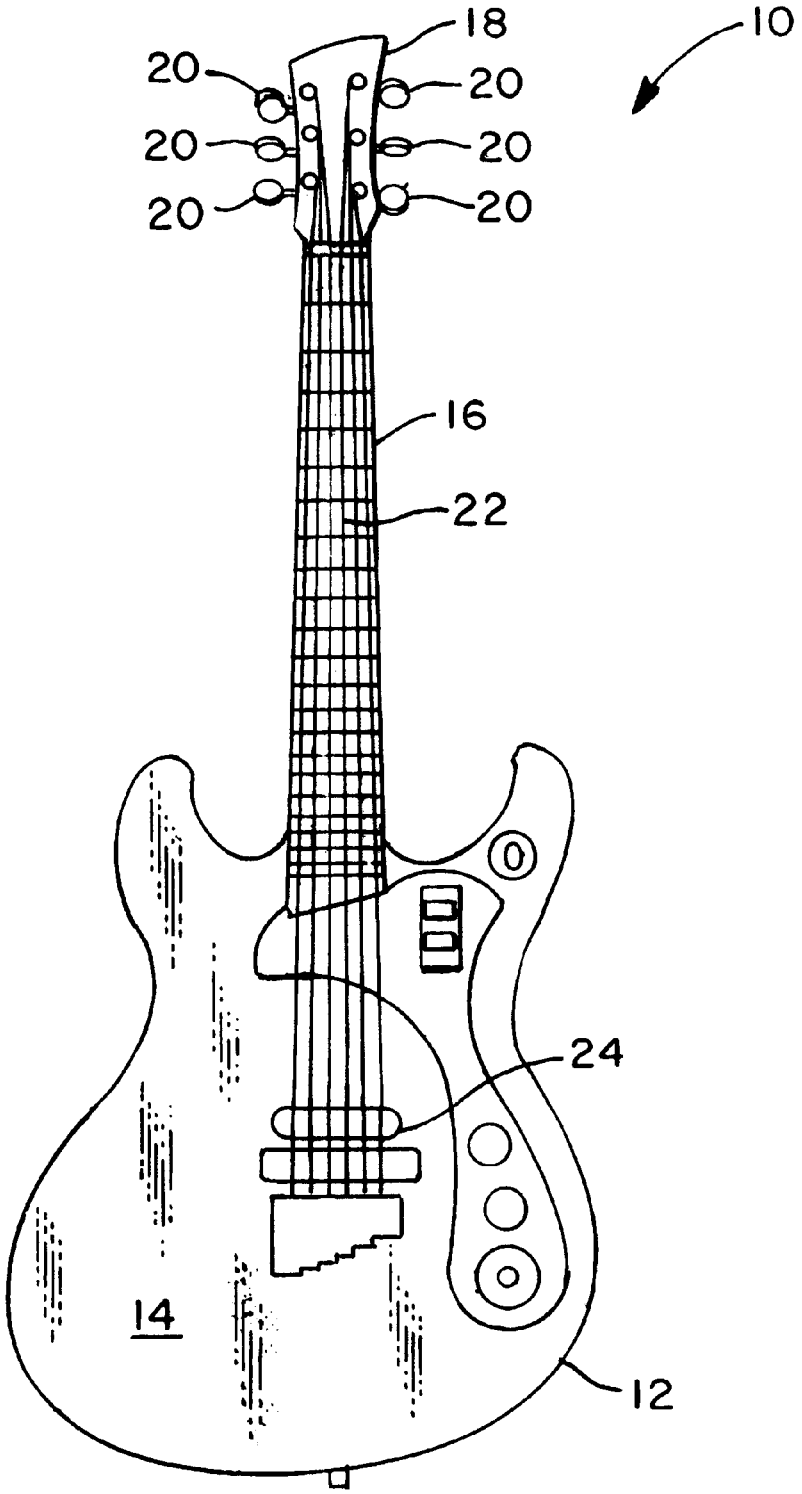
FIG. 1 is a front elevational view of a typical guitar.

Referring now to FIG. 1 there are a shown a typical guitar 10 having a body 12 which includes a soundboard 14, and an elongated neck 16 and a head or headstock 18 that includes a tuning machine. The tuning machine includes keys 20. Typically there are six such keys 20, although various guitars may have other numbers of keys an accordingly other numbers of strings 22. Each string 22 extends from one of the keys 20 to a saddle and bridge assembly 24 disposed on the soundboard 14.

Figure 4:
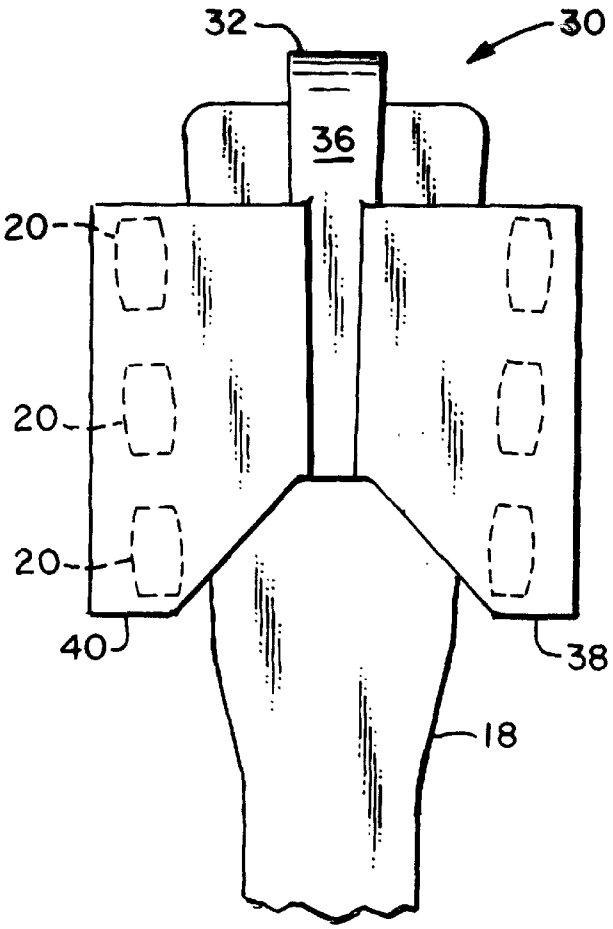
FIG. 4 is a fragmentary partially schematic rear elevational view of a headstock of a typical guitar on which the first embodiment of the present invention is installed.
Figure 3:
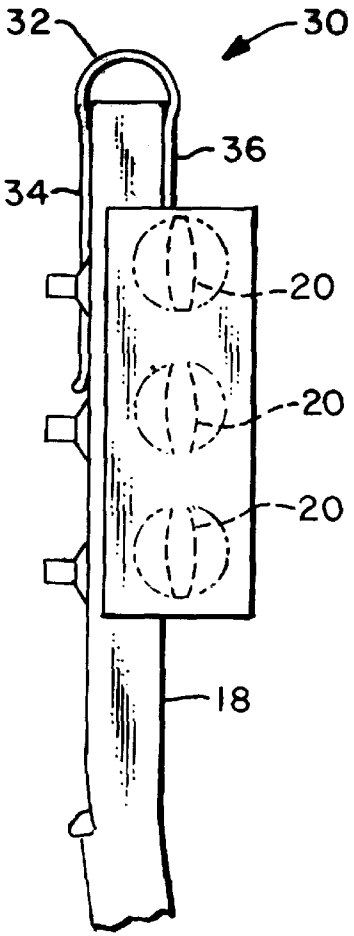
FIG. 3 is a fragmentary partially schematic side elevational view of a headstock of a typical guitar on which the first embodiment of the present invention is installed.
Figure 2:
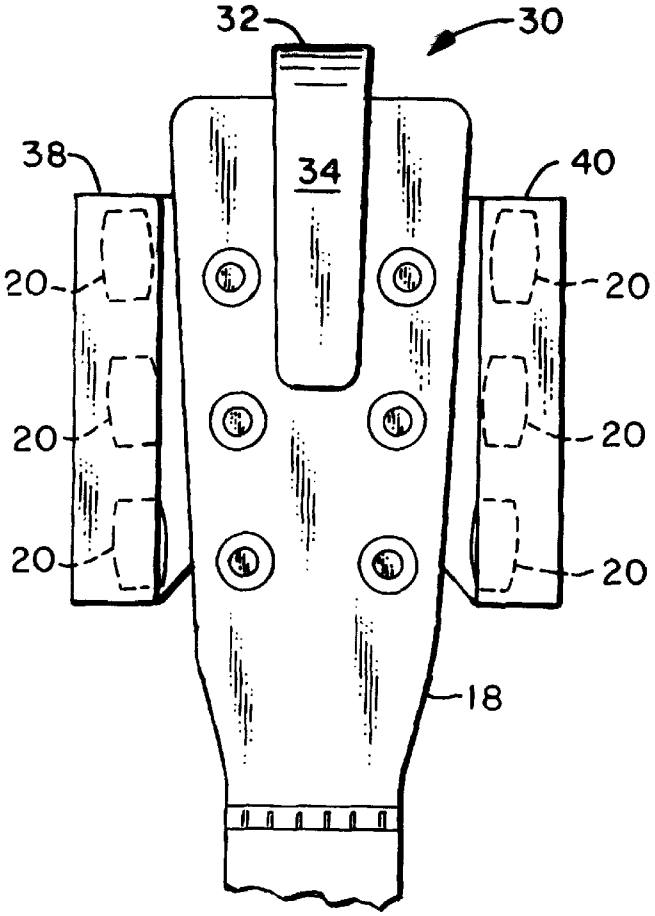
FIG. 2 is a fragmentary partially schematic front elevational view of a headstock of a typical guitar on which a first embodiment of the present invention is installed.

A first embodiment of the apparatus in accordance with the invention is shown in FIGS. 2–5 and FIG. 9. This embodiment is a one-piece molded plastic guard assembly 30. The guard assembly 30 includes a bracket 32 that is generally U-shaped. The bracket 32 includes spaced legs 34, 36 that are each generally planar and mutually parallel in which are dimensioned and configured for engagement with the opposed faces of the headstock 18 as best shown in FIGS. 2–4. The guard assembly 32 further includes two guard elements 38,40. Each of the guard elements is elongated and concave and dimensioned and configured to nest around the keys 20 on one side of the tuning machine which is part of the headstock 18.

The guard assembly 30 is shown in and main drawing installed on the associated guitar 10. It will be understood by those skilled in the art that when the user wishes to change the tuning adjustments on the guitar 10 or when the user wishes to play the guitar 10 he will slide the guard assembly 30 upwardly (as viewed) away from the soundboard 14. The surfaces of the guard assembly 30 that abut the headstock 18 are preferably provided with a felt cloth or similar covering to avoid scratching the surface of the headstock 18. Alternatively a rubber material may be affixed to the surfaces of the guard assembly 30 that abut the headstock 18. Such a material has the advantage of not only preventing scratching but also insurers that the guard assembly 30 will not inadvertently slip on the headstock 18.

Figure 5:
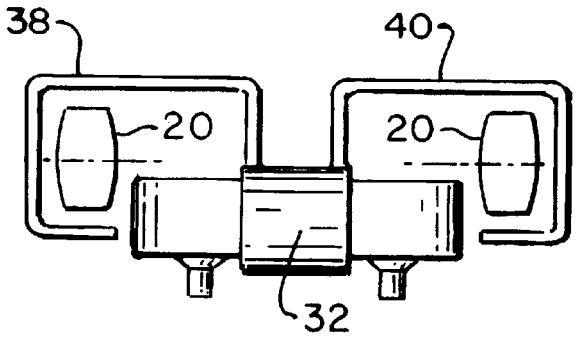
FIG. 5 is a fragmentary partially schematic plan view of a headstock of a typical guitar on which the first embodiment on the present invention is installed.
Figure 6:
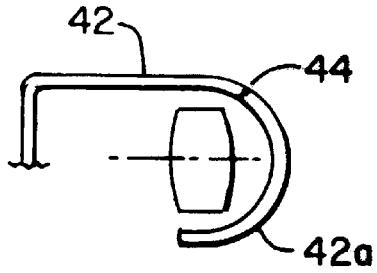
FIG. 6 is a fragmentary plan view of a part of a guard assembly in a second embodiment of the present invention.

The embodiment described above has respective guard elements 38,40 that each have a generally rectangular form as best seen in FIG. 5. In other embodiments of the invention, such as that shown in FIG. 6, a guard element 42 it is functionally similar to the guard element 40 however, preferably main contour much more curved than if it the embodiment illustrated in FIGS. 2–5 and 9 may have a shape which is more rounded. In other words the contour of the illustrated guard element may include a least a part that is a cylindrical section. The structure illustrated in FIG. 6 is the functional equivalent of the element 40 shown in FIG. 5. In some embodiments of the invention the respective guard assemblies may be provided with a so-called living hinge 44. The free end 42*a* is movable between the illustrated position (a first position) and a second position in which the free end 42*a* case spaced away on the keys 40 so that tuning adjustments may be made without removing the guard assembly.

Figure 7:
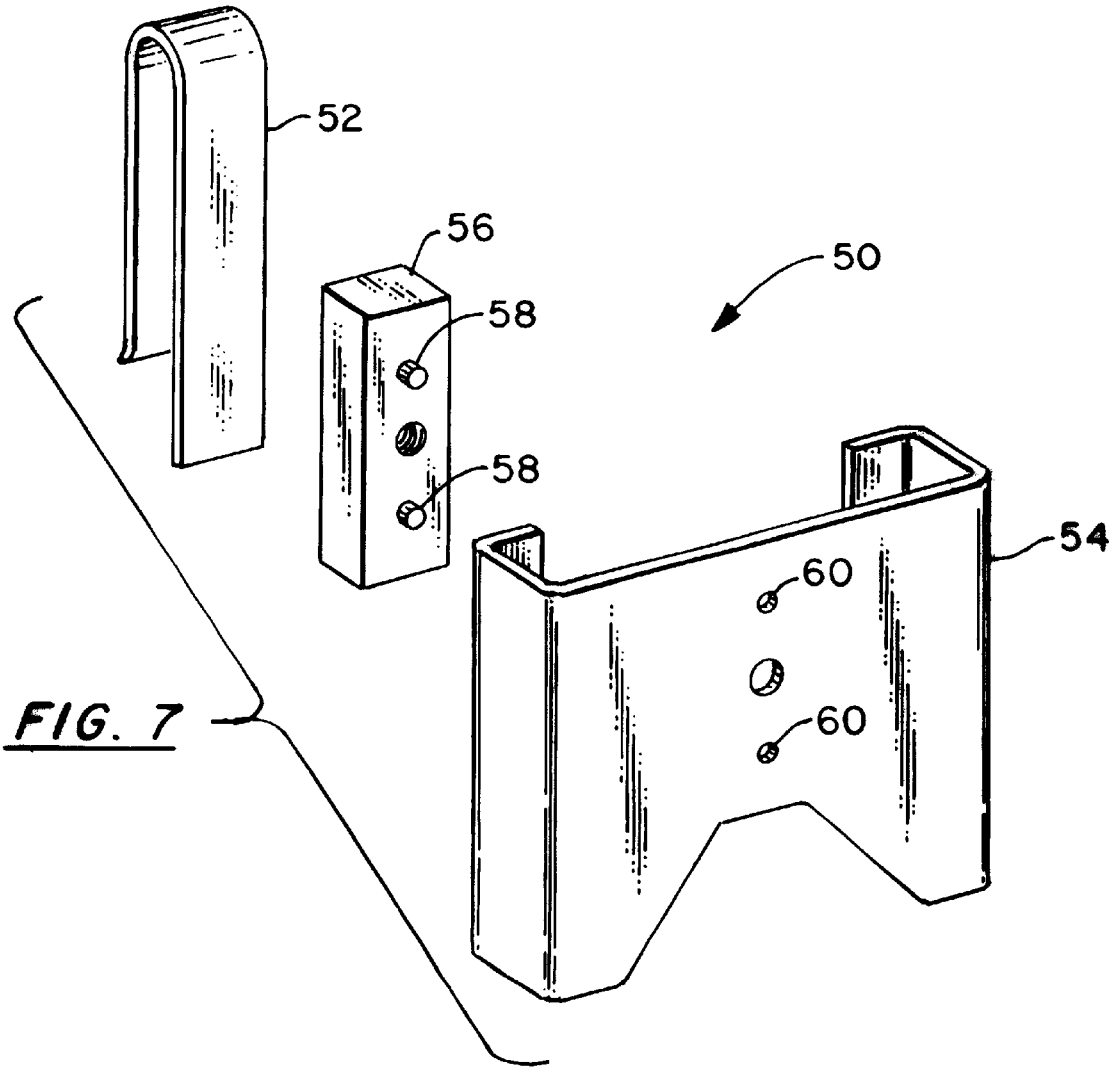
FIG. 7 is an exploded perspective view of a third embodiment of the present invention.
Figure 9:
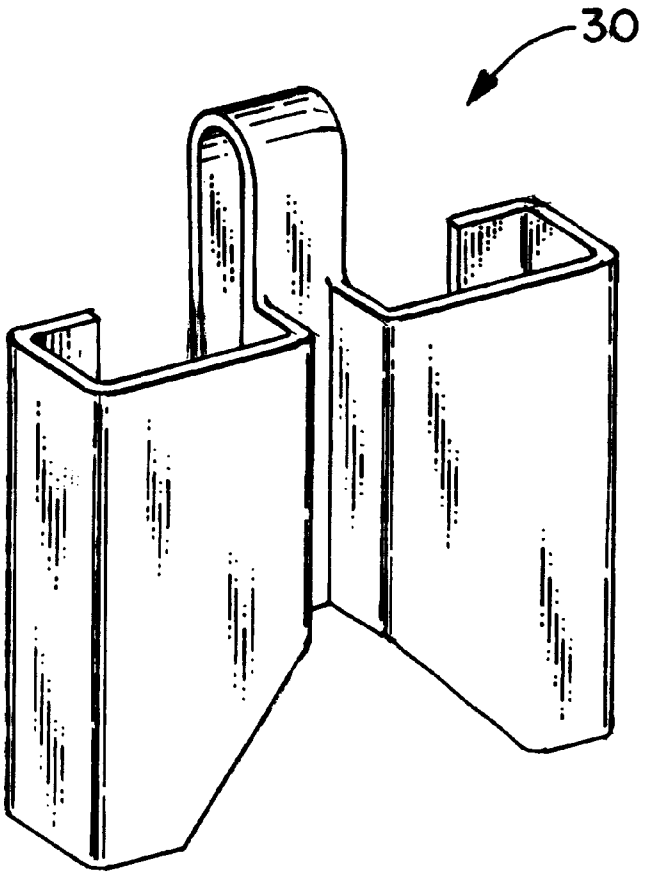
FIG. 9 is a perspective view of the first embodiment of the present invention illustrated in FIGS. 2–5.
Figure 8:
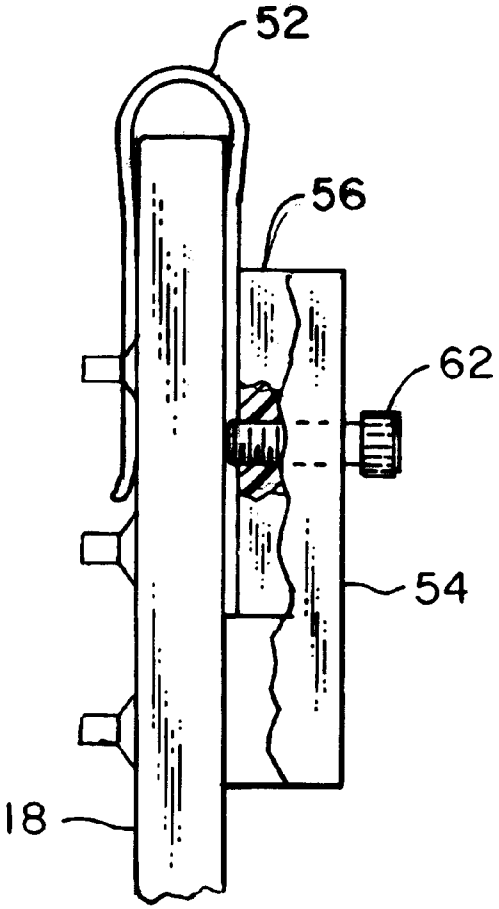
FIG. 8 is a fragmentary partially sectional side view of the embodiment illustrated in FIG. 7.

The guard assembly 50 illustrated in FIGS. 7 and 8 utilizes 3 plastic pieces. They are a clamp 52 that is dimensioned and configured for engagement with the head of the guitar, and a unitary guard member 54 dimensioned and configured to expand around the tuning keys 20 of an associated guitar and a spacer block 56 to connect the unitary guard member 54 and the clamp 52 in spaced relationship. Posts 58,58 on the upper (as viewed) face of the spacer block 56 register with openings 60, 60 in the guard member 54. A bolt 62 extends through the guard member 54 and spacer block 56 and then into the clamp 52.

The choice of the particular embodiment for any given application will vary with the requirement solve the user having thus described the invention, those skilled in the art will understand that various other forms of the invention may be constructed without departing from the spirit of the disclosed invention. Thus, it will be understood that the present invention is limited only by the following claims.

What is claimed is:

1. A guard assembly for preventing accidental movement of the tuning adjustments for adjusting the tension of strings on an associated string instrument, said guard assembly including:

a bracket, said bracket being generally U-shaped and having spaced legs dimensioned and configured for gripping opposed surfaces of the head of an associated string instrument, said guard assembly further including first and second guard elements mounted on said bracket, each of said guard elements being generally sleeve shaped an dimensioned and configured to extend around a plurality of keys on the associated string instrument.

2. A guard assembly as described in claim 1 wherein:

said spaced legs are each substantially planar and are disposed in mutually parallel relationship, said legs being joined by a portion of said bracket which is dimensioned and configured to provide means for elastic engagement of the spaced legs with opposed surfaces of the associated head of the associated string musical instrument.

3. A guard assembly as described in claim 2 wherein:

said guard assembly is substantially entirely manufactured from a single piece of plastic.

4. A guard assembly as described in claim 3 wherein:

at least a part of each of said guard elements are supported by a plastic hinge whereby said part is movable away from keys of the associated guitar.

5. A guard assembly as described in claim 1 wherein:

each of said guard elements being movable between a first position in which each of said guard elements is disposed in closely spaced relationship to associated tuning elements of the associated string musical instrument and a second position wherein said guard elements are positioned in more widely spaced relationship to the associated tuning elements of the associated string musical instrument.

6. A guard assembly for use with an associated string instrument which includes:

a discrete bracket, said bracket being generally U-shaped and having spaced legs dimensioned and configured for gripping opposed surfaces of the head of the associated string instrument, a guard member having integral first and second guard elements, each of said guard elements being generally sleeve shaped and dimensioned and configured to extend around a plurality of keys on the associated string instrument.

7. A guard assembly as described in claim 6 wherein:

said spaced legs are each substantially planar and are disposed in mutually parallel relationship, said legs being joined by a portion of said bracket which is dimensioned and configured to provide means for elastic engagement of the spaced legs with opposed surfaces of the associated head of the associated string musical instrument.

* * * * *